US006634311B2

(12) United States Patent
Cudd, III et al.

(10) Patent No.: US 6,634,311 B2
(45) Date of Patent: Oct. 21, 2003

(54) APPARATUS AND METHOD FOR GUIDING AND HOISTING A SAIL

(76) Inventors: G. Benjamin Cudd, III, 9933 Lakepointe Ct., Burke, VA (US) 22015; Sonia Galindo, 4 Ashford Ct., Annapolis, MD (US) 21403

( * ) Notice: Subject to any disclaimer, the term of this patent is extended or adjusted under 35 U.S.C. 154(b) by 4 days.

(21) Appl. No.: 10/050,140

(22) Filed: Jan. 18, 2002

(65) Prior Publication Data

US 2003/0136323 A1 Jul. 24, 2003

(51) Int. Cl.[7] ..... B63H 9/04
(52) U.S. Cl. ..... 114/105; 114/108
(58) Field of Search ..... 114/102.1, 102.15, 114/104, 105, 108, 113

(56) References Cited

U.S. PATENT DOCUMENTS

| | | | | |
|---|---|---|---|---|
| 3,658,025 A | | 4/1972 | Hood et al. | 114/105 |
| 3,759,210 A | | 9/1973 | Davis | 114/105 |
| 3,802,373 A | | 4/1974 | Lagerquist | 114/105 |
| 3,851,609 A | * | 12/1974 | Stearn | 114/105 |
| 3,948,200 A | | 4/1976 | Hood et al. | 114/105 |
| 4,090,461 A | | 5/1978 | Rusich | 114/107 |
| 4,236,475 A | | 12/1980 | Merry | 114/90 |
| 4,340,005 A | | 7/1982 | Lagerquist | 114/105 |
| RE31,829 E | | 2/1985 | Stearn | 114/105 |
| 4,619,216 A | | 10/1986 | Crear, III et al. | 114/105 |

* cited by examiner

*Primary Examiner*—Stephen Avila
(74) *Attorney, Agent, or Firm*—Whiteford, Taylor & Preston LLP; Jeffrey C. Maynard; Gregory M. Stone

(57) ABSTRACT

An apparatus and method for guiding a sail while it is being hoisted on a sail-powered marine vessel are disclosed. The apparatus is a pre-feeder or feeder for use on a forestay, mast or foremast; the apparatus having two oppositely-facing members that are movable in relationship to each other thereby forming an adjustable opening for receiving and partially encircling the luff portion of a sail. The two members are movable about a hinge and a locking mechanism prevents the members from separating inadvertently. For use with a forestay, the pre-feeder is attached near the bow of the boat or directly to the forestay below the grooved track on the forestay and helps guide a the luff portion of a jib sail into the grooved track. The method of using the pre-feeder includes gripping the two members and pulling them apart, inserting the luff, closing the two members, and pulling on a halyard attached to the sail. The apparatus and method of the present invention can reduce the time required to hoist a sail and may be performed by a single crew member.

22 Claims, 5 Drawing Sheets

APPARATUS AND METHOD FOR GUIDING AND HOISTING A SAIL

BACKGROUND OF THE INVENTION

1. Field of Invention

The present invention pertains to sail management systems on sail-powered marine vessels and specifically to systems used in connection with guiding and hoisting or lowering a sail on a forestay, mast or foremast using a pre-feeder or feeder with an adjustable opening.

2. Description of the Prior Art

Pre-feeder devices used with a forestay to hoist a jib sail on a sail-powered vessel are well known in the art. Representative patents describing such pre-feeders and sail management systems include U.S. Pat. No. 3,658,025 (to Hood et al.); U.S. Pat. No. 3,759,210 (to Davis); U.S. Pat. No. 3,948,200 (to Hood et al.); U.S. Pat. No. 4,340,005 (to Lagerquist); U.S. Pat. No. 4,619,216 (to Creer III et al.) and RE31,829 (to Stearn). These patents disclose various commonly used mechanical sail management systems available to competitive and leisure sail boaters. In particular, these patents disclose pre-feeders made from extruded, injection molded, die cut, stamped or bent plastic, metal or a combination of plastic and metal. They are assembled to provide a fixed opening adaptable for loosely encircling the luff portion of a jib sail.

A jib sail is an essentially triangular-shaped sail, the three edges of which are typically referred to as the luff, leach and foot. The luff is the forward or leading edge of the sail closest to the bow of the boat. The leach is the rearward or aft most portion of the sail. The foot is the bottom edge of the sail and generally runs parallel to the boat deck.

The luff portion of a sail consists of a bead made from plastic tube, bolt rope or other flexible, durable, and generally cylindrical or oval-shaped material that is typically sewn to the luff edge of the sail. This area may be reinforced with a polymeric tape or nylon fabric that is wrapped around and attached to the luff edge of the sail with adhesive or stitches (i.e., the "luff tape portion" of the sail). A halyard rope is attached to the upper head of the sail and is used to raise the sail.

A mast of a sail boat is attached approximately at the center of the boat and vertically extends in a substantially perpendicular direction relative to the plane of the boat deck. A forestay extends from the bow of the boat to the top of the mast (or foremast, if one is present). Its principal use is to support the mast (or foremast) and to hold the jib sail (also called a Genoa sail or head sail). The forestay may include a C-shaped or V-shaped groove running parallel to the longitudinal axis of the forestay. The groove includes a slot that is large enough to contain the plastic bead or bolt rope of the luff-edge of the jib sail but has a slot opening that is small enough to prevent the plastic bead or bolt rope from pulling free from the groove when the sail is hoisted.

The forestay may include a feeder at the base of the groove to facilitate feeding the luff into the groove, although often there is no feeder or other extending member near the groove opening. Because the jib sail is often folded in layers on the deck of the boat (or in a hold below deck in some boats), the luff needs to be positioned generally parallel to the forestay before it enters the feeder (or directly into the groove opening in the case where there is no feeder) to prevent the luff from bunching at the feeder/groove opening or, worse, causing the jib sail to tear. This pre-positioning is accomplished by using a pre-feeder below the feeder (or below the groove opening where no feeder is used). The pre-feeder is usually tied to the bow of the boat or the bottom of the forestay below the groove using a rope or flexible attaching arm. This method of attaching allows the pre-feeder to move back and forth to accommodate the luff movement as it deploys from its folded position, and pre-feeds the luff so that it enters the groove (or feeder) in a nearly parallel position relative to the groove on the forestay.

Similarly, the mast or foremast may include a feeder positioned just below the groove or track on the mast or foremast. The feeder is used for pre-positioning the luff portion of a sail so that the sail enters the groove on the mast or foremast in nearly a parallel position in the same manner that the pre-feeder positions the jib sail with respect to the forestay.

U.S. Pat. No. 3,658,025 discloses a single cast or extruded plastic guide with two concave guide members forming a generally C-shaped enclosure for loosely encircling the luff portion of a jib sail. The extremities of the two guide members have a gap between them large enough to allow the luff tape portion of the jib sail to pass between them. The patent illustrates how the guide is attached to the lower portion of a forestay or the deck of a boat to position the pre-feeder below the opening a grooved forestay feeder. The attaching device is a flexible link that includes a round eyelet on each end.

U.S. Pat. No. 4,619,216 discloses essentially a single metal rod formed into a V-shaped pre-feeder with plastic or metallic rollers connected to the ends of the two guide members. As with other pre-feeders, the V-shaped pre-feeder includes an opening or gap between the ends of the guide members, and between the rollers attached thereto, for loosely holding the luff between the members while allowing the sail luff tape portion to pass between them. As illustrated in this patent, the pre-feeder is attached to a forestay using a rope securely looped around and knotted to the pre-feeder. Commercially available pre-feeders of this type may not have rollers and may have a support bar connecting the two members for dimensional rigidity (i.e., to resist torsional and bending forces).

U.S. Pat. No. 3,759,210 discloses a single, die cut, cast or extruded pre-feeder attached to a forestay by a rope, the pre-feeder including a C-shaped yoke with two rounded sail-contact members forming a luff-holding opening. A gap is provided between the contact members for allowing the sail sheet to pass between. The disclosed device is intended to prevent a substantial amount of the sail cloth from gathering within the pre-feeder under various conditions.

Various methods of attaching a pre-feeder to a boat are also well known in the art. In addition to the attaching devices described above, U.S. Pat. No. 4,340,005 discloses a pre-feeder attached to a forestay below the forestay track feeder using a spherically-shaped retainer that encircles the forestay. The retainer includes two circular parts hinged on one end and connected together on the other end with a pin.

Similar to the above pre-feeders for use with forestays, feeder systems used to guide and hoist a mainsail (or foremast sail) are also well known in the art. U.S. Pat. No. 4,090,461 (to Rusich) and U.S. Pat. No. 4,236,475 (to Merry) are exemplary of such feeders. U.S. Pat. No. 4,090,461 discloses a two-member feeder attached to a mast with each member being attached on opposite sides of a C-shaped grooved track parallel to the longitudinal axis of the mast, thereby forming a small gap between the ends of the two members. The gap provided by the two members is large enough for a sail to pass between them, but is smaller than the diameter of the plastic bead or bolt rope that is integrated into the sail luff edge. The feeder is welded or bolted to the outside of the mast.

U.S. Pat. No. 4,236,475 discloses another two-member feeder attached to a mast with each member projecting away from the surface of the mast at an angle forming a triangular shape feeder. As illustrated in the patent, the tips of the two members form a gap that is large enough for the luff tape portion of the sail to pass between them, but is smaller than the plastic bead or bolt rope of the mainsail luff that is being fed into a groove on the mast. The feeder is attached to the outside of the mast using four metal screws.

One problem with these prior art fixed-opening sail pre-feeders and feeders is that in order to hoist a sail on a grooved track forestay, mast or foremast, the head of the sail containing the leading end of the luff must be fed through the opening of the pre-feeder or feeder. This must be done because once the sail has been completely hoisted, the luff typically is no longer encircled by the pre-feeder or feeder. In the case of pre-feeders, for example, the pre-feeder typically drops off the jib sail after the full length of the luff portion of the jib sail passes through the pre-feeder and into the forestay track when the sail is raised. Thus, in order to re-raise the jib sail, for example after the jib sail has been doused, the head of the jib sail must be completely lowered out of the grooved track to the deck so that it can again be re-fed into the pre-feeder.

This creates several problems for sail boaters. In competitive sailboat racing, a crew member must move to the foredeck of the boat and, with one hand on the sail cloth near the luff and the other hand on the pre-feeder, make ready the jib sail to be hoisted by taking the luff of the sail completely out of the grooved track and re-feeding the luff through the pre-feeder a second time. It is not uncommon that two crew members will be assigned to perform this task because of the difficulty involved (i.e., one person must hoist the halyard while the other person mans the pre-feeder) and the need to complete the task expeditiously. Obviously, this reduces the boat's speed because of the additional weight over the bow and the delay in raising the jib sail. In addition, this process is inherently dangerous for the crew members standing near the bow in choppy conditions because of the need to use both hands as noted above.

The above problems are not limited to competition sail boat racing. Recreational sail boaters also rely on pre-feeders and feeders when hoisting sails. Although speed is not as much of an issue to some non-competition sail boaters, the remains that someone on the boat must first move to the foredeck, spending extended time at the front of the boat, to feed the sail through the pre-feeder before raising the jib sail or, in the case of the mast or foremast, be ready to handle the mainsail or foremast sail. This is particularly difficult when there is a small crew sailing the boat.

SUMMARY AND OBJECTS OF THE INVENTION

In view of the foregoing, it should be apparent that there exists a need for a more efficient sail management system on sail-powered marine vessels, including a system for guiding and hoisting a sail on a grooved track forestay, mast or foremast. Specifically, there exists a need for a pre-feeder or feeder that can be used to guide and raise and re-raise a sail without requiring the sail to be completely lowered, which would be more efficient and present less danger to sail boaters than current devices.

Accordingly, it is a principal object of the present invention to provide a jib sail pre-feeder that has an adjustable opening for receiving and partially encircling the luff portion of a jib sail.

It is another object of the invention to provide a mast or foremast feeder that has an adjustable opening for receiving and partially encircling the luff portion of a sail.

It is still another object of the invention to provide an adjustable opening device for use on marine vessels, the purpose of which is to feed and pre-feed a line, rope or bolt rope.

Still another object of the invention is to provide a sail pre-feeder or feeder that allows a sail to be partially lowered and then raised again without having to lower the sail completely or remove the sail luff completely from a grooved track to reposition the top of the luff portion between the opening of the device before raising the sail.

It is another object of the invention to provide a sail pre-feeder or feeder device that allows a single crew-member to operate the device with one hand.

It is still another object of the invention to provide a sail pre-feeder or feeder that can be removed from a sail without having to raise or lower the sail completely. described, these and other objects and features of the present invention are accomplished, as embodied and fully described herein, by an apparatus for use in guiding and hoisting a sail in connection with a grooved track on a forestay, mast or foremast. The present invention overcomes the problems associated with the prior art sail pre-feeders and feeders by providing a device in which the two members of the device can be opened to receive the luff portion of a sail and then closed to loosely secure the luff between the members of the device. Thus, the pre-feeder or feeder can be positioned on a sail when the sail is hoisted to any position on a grooved forestay, mast or foremast, avoiding the need to lower the sail completely out of the grooved track and to the boat deck and minimizing the time required to accomplish the task of hoisting a sail.

The present invention includes a first jaw member for receiving a luff, a second jaw member opposing the first jaw member, the second jaw member being movable in relationship to the first jaw member, and wherein the first and the second jaw members form an opening for partially encircling the luff. The embodiment may also include an eyelet extending through at least one of the members and a rope that is looped through and knotted to the eyelet for securing the apparatus to a sailboat. It may also include a groove cut into the first jaw member, a pin slidably connected to the second jaw member for tracking in the groove on the first jaw member, a stop connected to the pin for maintaining the pin in the groove, a cutout formed in the groove for receiving the stop and for securing the pin in a first position in the groove, and a spring disposed around the pin for holding the stop in the cutout. There is also a hinge or pivot for connecting the first and second members and about which the second jaw member moves in relationship to the first jaw member. The first and second jaw members are each made of one or more of the following materials: Delring®, carbon fiber, titanium, stainless steel, aluminum, and bronze.

The present invention is also directed to a method for guiding and hoisting a sail in connection with a grooved track on a forestay, mast or foremast, including the steps of providing a pre-feeder, wherein the pre-feeder comprises a first jaw member connected to a second jaw member such that the first jaw member is movable in relation to the second jaw member; gripping the first and second jaw members of the pre-feeder; opening the ends of the first and second jaw members of the pre-feeder to accept a luff-edge of a sail; inserting the luff-edge of the sail between the first and second jaw members; closing the pre-feeder thereby loosely and partially encircling the luff; and pulling on a rope tied to the top of the sail to raise the sail.

Additional aspects of the method of the invention include the step of tying one end of a rope to the pre-feeder and tying the other end of the rope to a boat, wherein the pre-feeder is positioned below the opening of a groove on the forestay; disengaging a locking mechanism before moving the ends of the pre-feeder; applying a force to a pin to disengage the locking mechanism before moving the ends of the pre-feeder; and feeding the top of the luff into a groove on the forestay before raising the sail.

Other objects, features and advantages of the present invention will become evident to one skilled in the art from the following detailed description of the invention in conjunction with the referenced drawings.

DETAILED DESCRIPTION OF THE INVENTION

Figure 1:
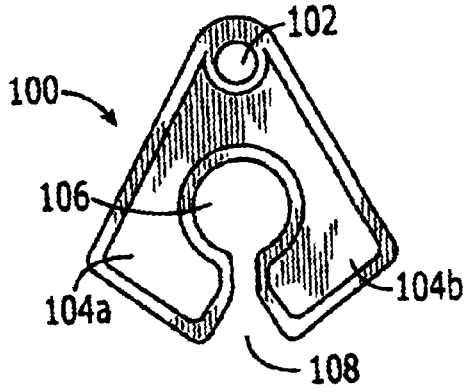
FIGURE 1 (PRIOR ART)
FIG. 1 is a top view of a prior art pre-feeder for use in raising a jib sail.

Several preferred embodiments of the invention are described for illustrative purposes, it being understood that the invention may be embodied in other forms not specifically shown in the drawings. Although the invention is described with reference to a forestay pre-feeder associated with a jib sail, other uses of the invention, such as a feeder attached to a mast or foremast or a device for loosely encircling a rope (i.e., a line feeder), are also fully contemplated. Moreover, while the invention of the pre-feeder is described for use in connection with guiding and hoisting a jib sail, it will be understood by one of ordinary skill in the art that the term jib sail is synonymous with other commonly used terms for jib sails including, but not limited to, "headsail" and "Genoa sail." Furthermore, forestay is meant to include other similar terms for the same device including, but not limited to, a "headstay" and "jibstay."

Referring first to FIG. 1, a top view of a prior art pre-feeder 100 for use in guiding and raising a jib sail is shown. The pre-feeder 100 is made of a single piece of plastic or other material having an eyelet 102 at the top and two members 104*a*, 104*b* forming a circular opening 106 for loosely encircling the luff of a jib sail (not shown). The gap 108 between the ends of the two members 104*a*, 104*b* is large enough to allow the luff tape portion of the sail to slide between them. The edges of the pre-feeder are beveled or rounded to prevent damage to the jib sail.

Figure 2:
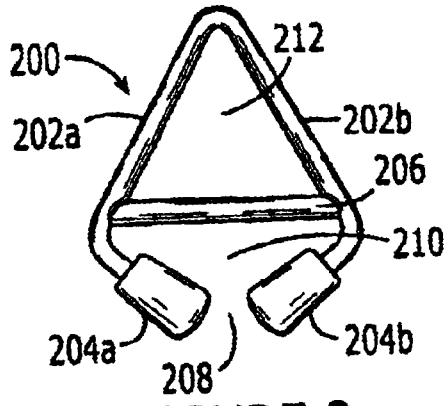
FIGURE 2 (PRIOR ART)
FIG. 2 is a top view of another prior art pre-feeder for use in raising a jib sail.

FIG. 2 shows a top view of another prior art pre-feeder 200 for use in guiding and raising a jib sail. The pre-feeder 200 is metallic (e.g., metallic wire). The two sail contact rollers 204*a*, 204*b* may be metallic, such as bronze, or plastic. The sail contact rollers 204*a*, 204*b* are attached at the free, confronting ends of members 202*a*, 202*b*, which together with the support art 206, form a generally triangular opening 210 for loosely encircling the luff of a jib sail (not shown). The gap 208 between the sail contact rollers 204*a*, 204*b* is large enough to allow the luff tape portion of the sail to slide between them. The members 202*a*, 202*b* and support arm 206 form another generally triangular opening 212 that can be used like the eyelet 102 of the pre-feeder of FIG. 1 (i.e., to attach a rope).

Figure 3:
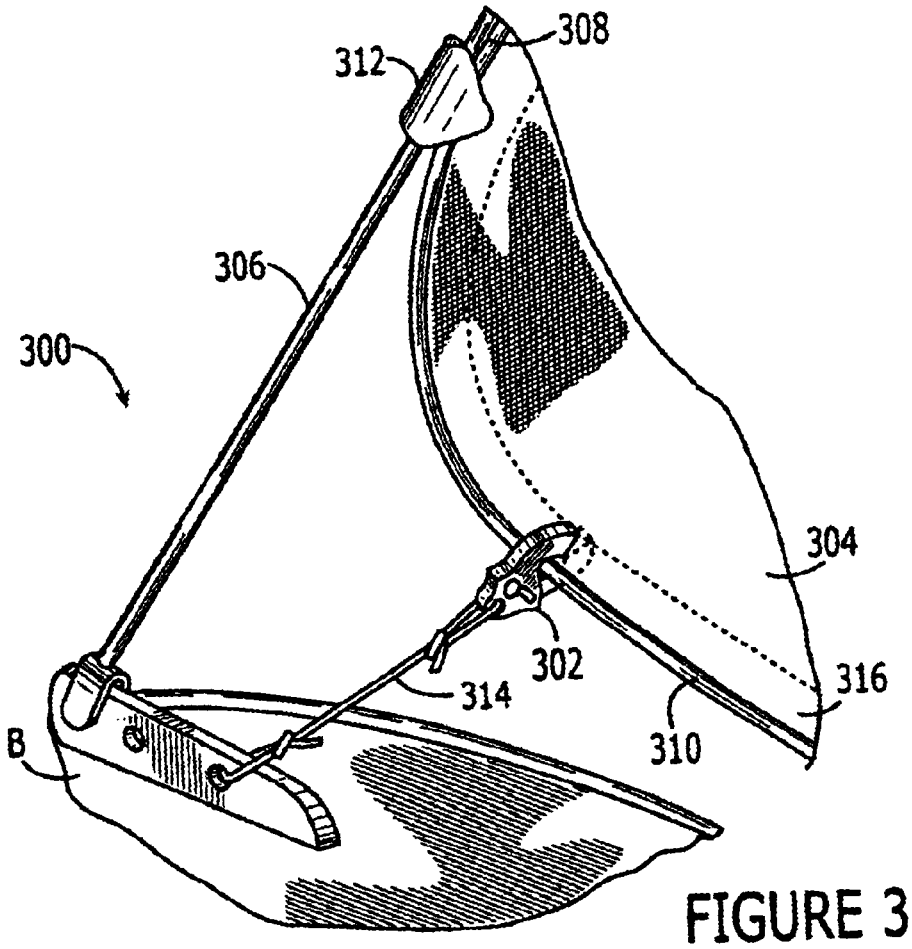
FIG. 3 is a perspective view of a pre-feeder according to the present invention being used to hoist a jib sail.

Now referring to FIG. 3, a pre-feeder 302 according to the present invention is being used to guide a jib sail 304 into a grooved track 308 on a forestay 306. One end of the forestay 306 is attached to the bow B of the boat 300 and the other end is attached to the top of the mast (not shown). The forestay 306 has a C-shaped or V-shaped grooved track 308 in which the luff 310 is held. In FIG. 3, a feeder 312 is used to guide the luff 310 into the groove 308. In some situations, the feeder 312 is not required to accomplish the task of guiding the luff 310 into the grooved track 308. Pre-feeder 302 aligns the luff 310 so that it is nearly parallel to the feeder 312 and the grooved track 308. The pre-feeder 302 is attached to the boat using an attaching arm 314, in this case a rope. As shown in FIG. 3, the pre-feeder 302 loosely encircles a portion of the luff 310. The luff tape portion 316, which consists of a wide strip of polymeric tape, woven nylon, or other material encapsulating the luff on both sides of the jib sail 304, slides between the jaw members of the pre-feeder 302.

FIG. 3 illustrates a common application of the pre-feeder 302 on a boat 300 in accordance with the present invention. Many alternative applications are also contemplated without deviating from the spirit and scope of the invention. For example, the attaching arm 314 may be attached directly to the forestay 306 or another portion of the bow B. The attaching arm 314 may be a rope, line or cable made of natural or synthetic strands of fibers or metal wires. It may also be a metallic or plastic arm that is universally attached to the boat so that the arm rotates about its longitudinal axis and flexes at one or more articulatable elbows to allow the pre-feeder 302 to move relative to the jib sail 304 as it is being hoisted.

Figure 4A:
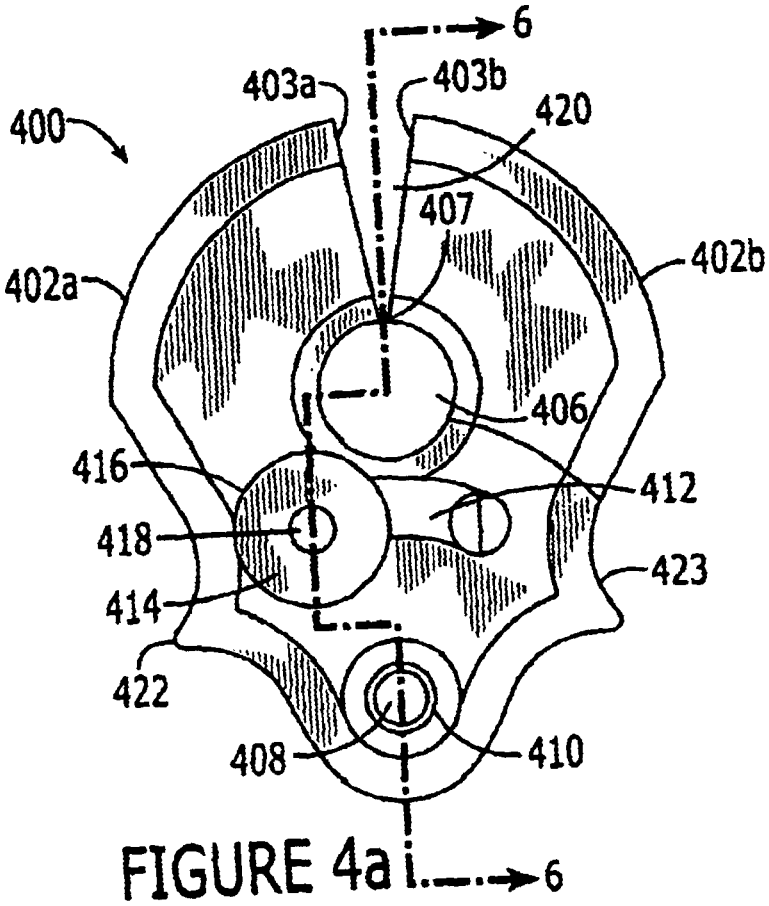
FIG. 4*a* is a top view of a first embodiment of a pre-feeder according to the present invention in the closed position.

Now referring to FIG. 4*a*, a top view of the first embodiment of pre-feeder 400 according to the present invention is shown. The pre-feeder 400 includes oppositely facing jaw members 402*a*, 402*b*, pivotally connected together at pivot 410. When the jaw members 402*a*, 402*b* are in a closed position (as shown in FIG. 4*a*), they form a circular opening 406 and a V-shaped throat 420 at the apex of which a gap 407 between the members is formed. It will be appreciated by one of skill in the art that the two oppositely facing jaw members 402*a*, 402*b* may be shaped to form other than a circular opening between them. Regardless of its shape, the opening 406 should be slightly larger than the luff 310 (FIG. 3) of a jib sail 304 (FIG. 3) so that the pre-feeder 400 can easily slide along the luff 310. Because different manufacturers of jib sails use slightly different sized beads or bolt ropes for the luff, opening 406 should be large enough to accommodate a range of different luff sizes. Also, the gap 407 is slightly larger than the thickness of the luff tape portion 316 of the jib sail 304 to also permit the pre-feeder 400 to slide along the luff tape portion 316. Preferably, the gap 407 should be about 1 millimeter when the jaw members 402*a*, 402*b* are in the closed position.

The oppositely facing ends 403*a*, 403*b* of the jaw members 402*a*, 402*b* form the throat 420 and are inclined with respect to one another at an angle of about 20–30 degrees. It is contemplated that the throat angle, and thus the maximum width of the opening of the throat 420, can be significantly larger than 20–30 degrees without altering the performance of the pre-feeder 400. It is also contemplated that the ends 403*a*, 403*b* may be contact rollers (a single roller or multiple rollers on each side) and they may be rounded instead of flat.

Figure 6:
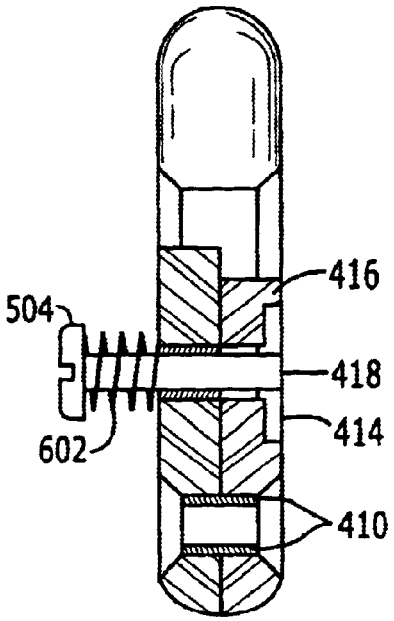
FIG. 6 is a cross-sectional view of the pre-feeder of FIG. 4*a* taken along line 6—6 showing the locking pin in the locked position.

In the first embodiment, the jaw members 402*a*, 402*b* are pivotally attached to each other at pivot 410. The pivot 410 in FIG. 4*a* is a cylindrical tube or eyelet extending through both jaw members 402*a*, 402*b* as best seen in FIG. 6. This is, however, not the only mechanism contemplated for pivotally connecting the two jaw members 402*a*, 402*b* together. For example, the pivot 410 could be similar to the hinge of a piano or door, in which each jaw member 402*a*, 402*b* includes a hinge plate connected to the other by a cylindrical pin passing through interleaved members of the hinge plates. A spring may be arranged around the hinge pin or between the jaw members 402*a*, 402*b* to bias the members to a closed position.

Furthermore, the pivot 410 could be replaced with a cylindrical pin attached to the members 402*a*, 402*b*, such that the longitudinal axis of the pin is parallel to the plane of the pre-feeder 400 of FIG. 4*a*, and where the jaw members 402*a*, 402*b* are circumferentially rotatable about the axis of the pin. Thus, the jaw members 402*a*, 402*b* would pivot relative to each other about the axis of the cylindrical pin. A torsion spring may be arranged around the pin and attached to the jaw members 402*a*, 402*b* to bias the members to a closed position.

Moreover, the pivot 410 could include a torque ratchet axially aligned with the pivot 410. In this configuration of the pivot 410, the notched ratchet wheel would be attached to one of the jaw members 402*a*, 402*b*, and the pawl and catch arms would be attached to the other member. The ratchet would allow the jaw members 402*a*, 402*b* to be opened in discrete intervals corresponding to the configuration of the notched ratchet wheel. A torsion spring could be used to bias the jaw members 402*a*, 402*b* to an opened or closed position when the catch is disengaged from the notched ratchet wheel.

The pivot 410 may be positioned approximately near the center of the pre-feeder 400, that is, above the gripping portions 422, 423 (FIG. 4*a*) thereby forming a pre-feeder that operates much like a pair of scissors. By applying opposing forces on the gripping portions 422, 423, the jaw members 402*a*, 402*b*, would open.

The pivot 410 could be replaced with one or more pins slidably attached to the jaw members 402*a*, 402*b* such that the longitudinal axis of the pin is parallel to the plane of the pre-feeder 400 of FIG. 4*a*. The jaw members 402*a*, 402*b* would move axially along the length of the pin in opposite directions. Thus, the jaw members 402*a*, 402*b* would slide apart rather than rotate about the pivot 410. A spring may be used to bias the jaw members 402*a*, 402*b* to a closed position. A screw, with one end attached to the jaw member 402*a* and the other end engaged in a receiving device in the jaw member 402*b*, could be used to move the two jaw members 402*a*, 402*b* along the axis of the pins, thereby adjusting the distance between the jaw members 402*a*, 402*b* very precisely.

The locking mechanism for the pre-feeder 400 includes an arcuate groove 412, stop 414, cutout 416, threaded pin 418 threadably engaged in stop 414, and spring 602 (FIG. 6). The groove 412 is formed through the member 402*a* as shown in FIG. 4*a*. It has a constant radius relative to the center of the pivot 410. When the jaw members 402*a*, 402*b* are pivoted about the pivot 410, the pin 418 travels along the groove 412. The two ends of the groove 412 define the extent to which the jaw members 402*a*, 402*b*, and hence the gap 407, can be opened to receive the luff 310 (FIG. 3). When the pre-feeder 400 is in the closed position as shown in FIG. 4*a*, the stop 414 engages in the cutout 416 by the force of the spring 602 as best seen in FIG. 6, thereby securely holding the two jaw members 402*a*, 402*b* locked together. To disengage the stop 414 from the cutout 416, the head 504 (FIG. 5*a*) of the pin 418 is urged against the bias of the spring 602 in the direction of the arrow a seen in FIG. 7.

The pivot 410 also forms an opening or eyelet 408 through both members 402*a*, 402*b*. The opening 408 may be used to attach the pre-feeder 400 to a sailboat as described above in connection with FIG. 3. Other means for attaching the pre-feeder 400 to a sail boat will be apparent to those of ordinary skill in the art.

The outer surfaces of the jaw members 402*a*, 402*b* include the two gripping portions 422, 423 that are outwardly extending from the surface of the jaw members 402*a*, 402*b*, respectively. An operator of the pre-feeder 400 could, for example, grip the pre-feeder 400 using the gripping portions 422, 423.

Several types of marine-compatible materials are contemplated for fabricating the jaw members 402*a*, 402*b* and may be used without deviating from the scope of the invention. One such material is Delrin® (DuPont), which is a machinable plastic with an acceptable combination of strength, stiffness, dimensional rigidity, and solvent and fuel resistant properties and is ideal for marine environments. Other suitable materials contemplated for the invention that are compatible with a marine environment include, but are not limited to, carbon fiber, titanium, stainless steel, aluminum and bronze. Carbon fiber and titanium are preferred in situations where strength and weight are important factors.

Similarly, several different marine-compatible materials are contemplated for the pivot 410, the stop 414, the pin 418 and the spring 602. These include, but are not limited to, titanium, stainless steel, aluminum, and bronze. The metallic surfaces may be metal-plated or coated with a non-metallic coating.

Figure 4B:
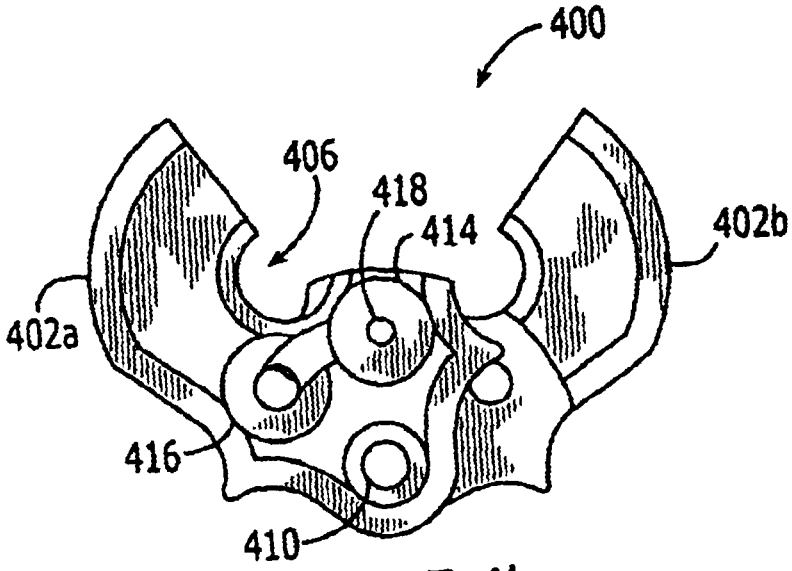
FIG. 4*b* is a top view of the pre-feeder shown in FIG. 4*a* in the open position.
Figure 5A:
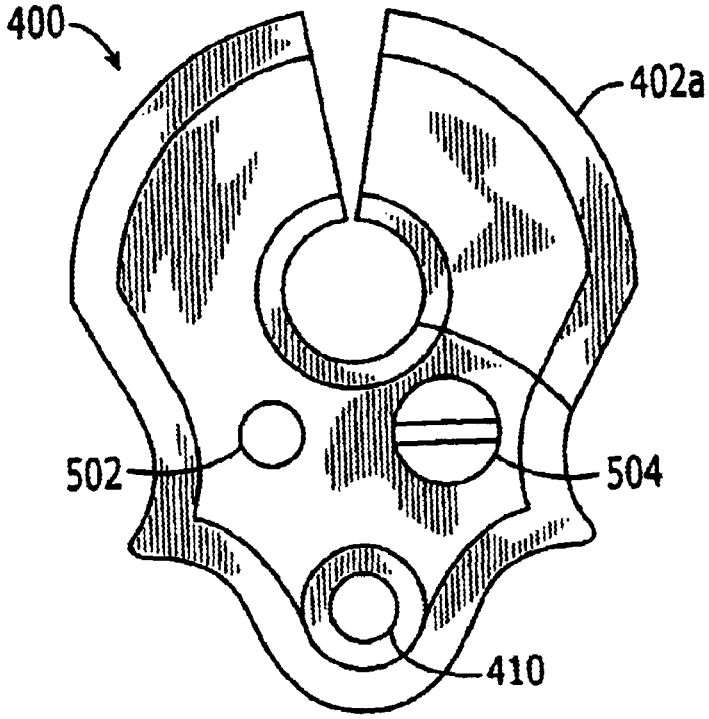
FIG. 5*a* is a bottom view of the pre-feeder of FIG. 4*a;*
Figure 5B:
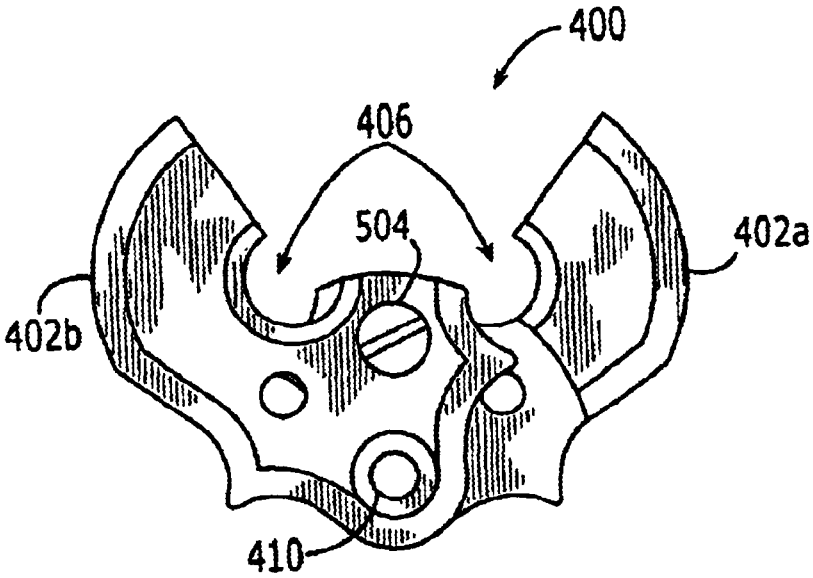
FIG. 5*b* is a bottom view of the pre-feeder of FIG. 5*a* in the open position.

FIGS. 4*b* and 5*b* show the pre-feeder 400 of FIG. 4*a* in the open position with the stop 414 disengaged from the cutout 416. In the fully opened position, the jaw members 402*a*, 402*b* allow the luff 310 to be readily inserted in the opening 406 after which the jaw members 402*a*, 402*b* are pivoted to the closed position of FIG. 4*a* and locked in that position by the engagement of the stop 414 in the cutout 416.

Now referring to FIG. 5*a*, a bottom view of the pre-feeder 400 of FIG. 4*a* is shown. The threaded pin 418 (FIG. 4*a*) includes a screw head 504 for adjusting the tension in spring 602 (FIG. 6). By adjusting the tension, the force required to disengage the stop 414 from the cutout 416 (FIG. 4*a*) can be changed. A boot or cover not shown may be used to cover the screw head 504 to prevent it from snagging or tearing the jib sail 304 (FIG. 3).

Referring to FIG. 6, the threaded pin 418 and screw head 504 are shown with the threaded pre-feeder 400 in the closed and locked position such that the stop 414 is engaged in the cutout 416 and held in place by the face of spring 602.

Figure 7:
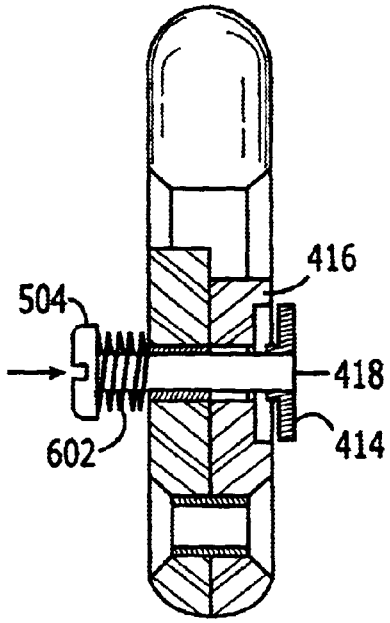
FIG. 7 is a cross-sectional view of the pre-feeder of FIG. 4*a* also taken along line 6—6 showing the locking pin in the unlocked position.

Now referring to FIG. 7, the stop 414 is shown disengaged from the cutout 416 by application of a force to the screw head 504 in the direction of the arrow. The required to disengage the stop 414 is a function of the spring constant, k, of the spring 602. Preferably, a spring is selected that will require a relatively large force to disengage the stop 414 and prevent the jaw members 402*a*, 402*b* from opening inadvertently during operation. However, the required force should not be so great that an operator cannot disengage the stop 414 by pressing a thumb or finger of one hand on the screw head 504 and pushing in the direction of the arrow shown in FIG. 7.

Figure 8A:
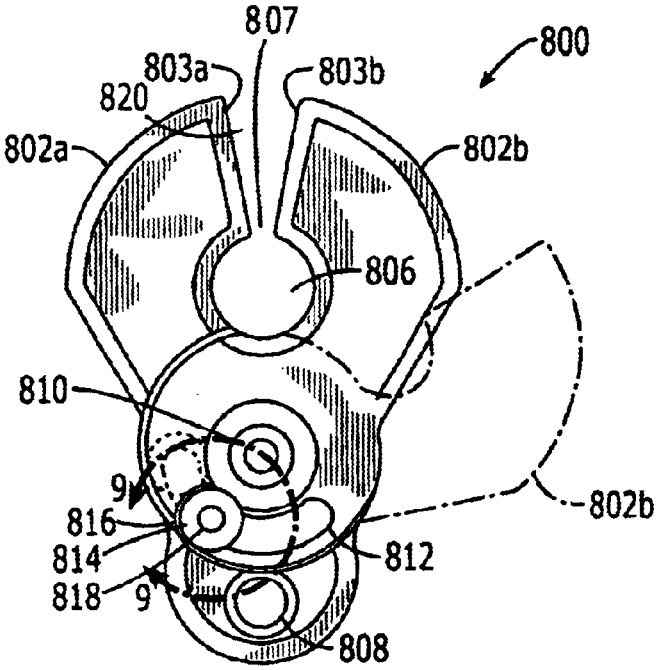
FIG. 8*a* is a top view of a second embodiment of a pre-feeder according to the present invention showing the feeder in the open and closed position.
Figure 8B:
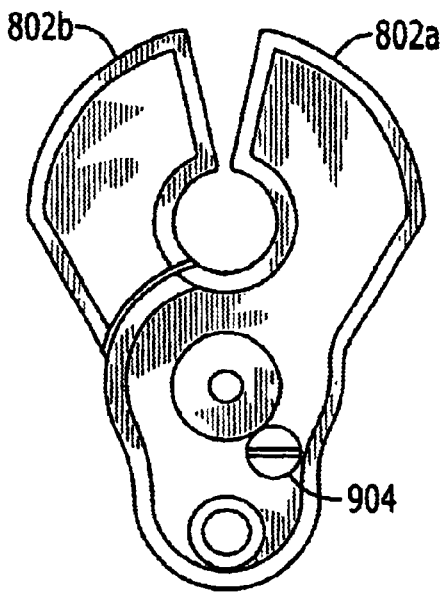
FIG. 8*b* is a bottom view of the pre-feeder of FIG. 8*a;*
Figure 9:
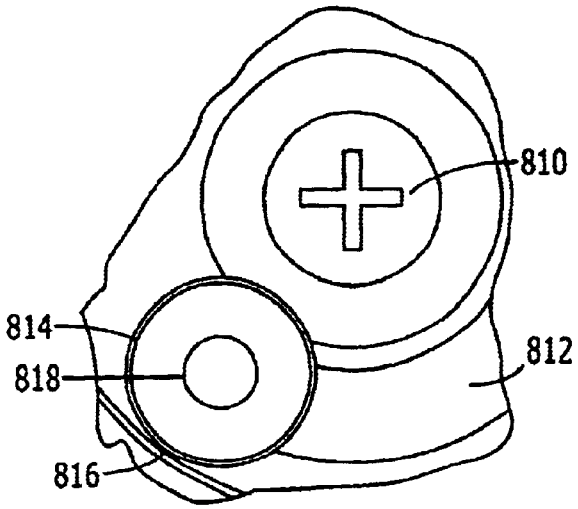
FIG. 9 is an enlarged fragmentary detail 9—9 of the locking mechanism of the pre-feeder of FIG. 8*a*.
Figure 10:
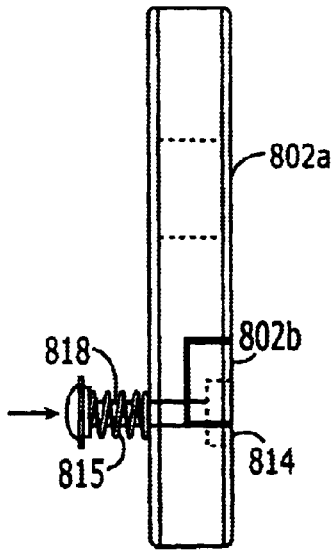
FIG. 10 is a left side view of the pre-feeder of FIG. 8*a.*

Now referring to FIGS. 8*b*, 9 and 10, the second embodiment of a pre-feeder 800 according to the present invention is shown. Pre-feeder 800 comprises oppositely facing jaw members 802*a*, 802*b* pivotally connected by pivot 810. In the closed position, they form a circular opening 806 and gap 807 at the apex of V-shaped throat 820. As in the previous pre-feeder embodiment, the gap 807 should be no smaller than the thickness of the luff tape portion 316 of the jib sail 304 (FIG. 3) and in any event should be no smaller than about 1 millimeters.

The oppositely facing end surfaces 803*a*, 803*b* of the jaw members 802*a*, 802*b* form the throat 820 and are inclined about 20–30 degrees between them. It is contemplated that the angle can be significantly larger than 20–30 degrees without altering the performance of the invention and, as in the first embodiment, the ends 803*a*, 803*b* may be contact rollers (a single roller or multiple rollers on each side) and may be rounded instead of flat.

The pivot 810 is a cylindrical pin disposed through both jaw members 802*a*, 802*b*. The pivot 810 could alternatively have the same form as the alternate pivot arrangements described above in connection with the first embodiment.

The locking mechanism for the pre-feeder 800 is also similar to that described previously in connection with FIG. 4*a*. In this embodiment, the locking mechanism includes an arcuate groove 812, stop 814, cutout 816, threaded pin 818, and a spring 815 (FIG. 10). These elements operate in substantially the same manner as previously described. As shown in dash-dot lines in FIG. 8*a*, jaw member 802*b* can be pivoted about pivot 810 relative to jaw member 802*a* to the open position when the stop 814 is disengaged from the cutout 816. An opening 808 is formed through member 802*a* and may be used to attach the pre-feeder 800 to a sailboat as described above in connection with FIG. 3.

FIG. 8*b* shows a bottom view of the pre-feeder 800 of FIG. 8*a*. The threaded pin 818 includes a screw head 904 for adjusting the tension in spring 815 (FIG. 10). By adjusting the tension, the force required to disengage the stop 814 from the cutout 816 (FIGS. 8*a* and 8*b*) can be changed. A boot or cover (not shown) may be used to cover the screw head 904 to prevent it from snagging or tearing the jib sail 304 (FIG. 3).

Now referring to FIG. 9, an enlarged view of a portion of the pre-feeder 800 of FIG. 8*a* is shown. Specifically, the stop 814 is shown engaged in the cutout 816 (i.e., the jaw members 802*a*, 802*b* are in the closed position).

Now referring to FIG. 10, a side view of the pre-feeder 800 of FIG. 8*a* is shown. Here is shown the spring 815 associated with the pin 818 and screw head 904. By applying force in the direction shown by the arrow, the stop 814 may be disengaged from the cutout 816 (FIG. 8*b*)) and the two jaw members 802*a*, 802*b* may be pivoted to the open position.

The pre-feeders 400 and 800 are operated essentially as follows (with reference to FIG. 3 and the elements of the pre-feeder 400). First, a crew member, standing near the bow B of the boat 300, grips the pre-feeder 400 in one hand. If the jib sail 304 has not been raised, the head of the jib sail with the leading edge of the luff 310 is inserted in the feeder 312 (if present) or the groove 308. The pre-feeder 400 is opened by pressing on the screw head 504 to disengage the stop 414 from its position in the cutout 416. The jaw members 402*a*, 402*b* are then pulled apart and placed around the luff 310 at a point on the luff 310 below the point where the luff 310 enters the feeder 312 or groove 308. The crew member then presses the jaw members 402*a*, 402*b* together thereby partially encircling the luff 310 within the opening 406 until the stop 414 re-engages the cutout 416. Then, a halyard connected to the head of the jib sail 304 is used to hoist the jib sail 304 and the pre-feeder 400 guides the luff into the feeder 312 or directly into the groove 308.

Although certain presently preferred embodiments of the disclosed invention have been specifically described herein, it will be apparent to those skilled in the art to which the invention pertains that variations and modifications of the various embodiments shown and described herein may be made without departing from the spirit and scope of the invention. Accordingly, it is intended that the invention be limited only to the extent required by the appended claims and the applicable rules of law.

We claim:

1. A pre-feeder apparatus for use in guiding and hoisting a sail on a stay of a sailboat, the sail having a luff, comprising first and second jaw members for receiving the luff of the sail, the jaw members being connected in opposing relationship and being articulatable relative to each other between open and closed positions of the jaw members, the first and second jaw members forming an opening between them for slidably engaging the luff in the closed position of the jaw members.

2. The pre-feeder apparatus of claim 1, further comprising attachment means connected to one of the jaw members for attaching the pre-feeder apparatus to the sailboat.

3. The pre-feeder apparatus of claim 2, wherein said attachment means comprises an eyelet extending through at least one of the first and second jaw members and a flexible strand looped through the eyelet and knotted.

4. The pre-feeder apparatus of claim 3, wherein the eyelet is a cylindrical tube comprising a pivot connecting the first and second members about which the members pivot relative to one another.

5. The pre-feeder apparatus of claim 2, wherein said attachment means comprises an arm having a longitudinal axis and being flexibly attached to at least one of the first and second jaw members, that arm being rotatable about its longitudinal axis.

6. The pre-feeder apparatus of claim 1, including means for locking the jaw members in the closed position.

7. The pre-feeder apparatus of claim 1, wherein the means for locking the jaw members in the closed position comprises a cutout in one of the jaw members, a locking pin extending through the jaw members and having a stop thereon for engaging in the cutout, the locking pin being movable between a locked position with the stop engaged in the cutout to retain the jaw members in their closed position and an unlocked position with the stop disengaged from the cutout to permit the jaw members to be articulated to their open position.

8. The pre-feeder apparatus of claim 7, including a groove in the one jaw member, the locking pin passing through the groove and being movably guided in the groove when the stop is disengaged from the cutout and the jaw members are articulated to the open position.

9. The pre-feeder apparatus of claim 7, including a resilient element having a biasing force urging the locking pin to its locked position.

10. The pre-feeder apparatus of claim 9, including means for adjusting the biasing force of the resilient element.

11. The pre-feeder apparatus of claim 10, wherein the locking pin is a threaded screw with a screw head and the resilient element is a spring arranged concentrically on the threaded screw between the screw head and one of the jaw members, the adjusting means comprising the threaded screw and a thread in the stop for adjusting the distance between the screw head and the one jaw member.

12. The pre-feeder apparatus of claim 1, wherein the first and second jaw members are each made of one or more materials selected from the group consisting of Delrin®, carbon fiber, titanium, stainless steel, aluminum, and bronze.

13. The pre-feeder apparatus of claim 1, including a hinge connecting the first and second jaw members.

14. The pre-feeder apparatus of claim 1, wherein the first and second jaw members have opposing ends, the opposing ends having a gap therebetween when the jaw members are in the closed position for receiving the luff.

15. The pre-feeder apparatus of claim 9, wherein the gap ranges from about 1 millimeter to about 100 millimeters.

16. The pre-feeder apparatus of claim 1, further comprising arcuate gripping portions on the jaw members for manually gripping the jaw members.

17. The pre-feeder apparatus of claim 14, wherein the opposing ends of the jaw members are disposed at an angle that diverges away from the gap and the opening between the jaw members.

18. A pre-feeder apparatus for use in guiding and hoisting a sail on a forestay of a sailboat, the sail having a luff, comprising first and second jaw members for receiving the luff of the sail, a pivot member pivotally connecting the jaw members in opposing relationship, the jaw members being pivotable relative to each other between open and closed positions, the first and second jaw members forming an opening and a gap between them for slidably engaging the luff in the closed position of the jaw members, and means for locking the jaw members in the closed position.

19. The apparatus of claim 18, further comprising attachment means for securing the pre-feeder apparatus to the sailboat.

20. A method for raising a sail on a stay of a sailboat, the sail having a luff, comprising the steps of:

providing a pre-feeder comprising first and second jaw members connected in opposing relationship and being articulatable relative to each other between open and closed positions of the jaw members, the first and second jaw members forming an opening and a gap between them in the closed position;

opening the first and second jaw members to the open position;

inserting the luff of the sail between the first and second jaw members;

closing the first and second jaw members to the closed position to slidably engage the luff in the opening and gap between the jaw members; and raising the sail on the stay such that the luff slides upwardly through the opening and gap between the jaw members.

21. The method of claim 20, further comprising the step of flexibly securing the pre-feeder to the sailboat.

22. The method of claim 21, wherein the stay is a forestay with a groove and the sail is a jib sail, further comprising the step of engaging the luff in the groove of the forestay.

* * * * *